US008806848B2

(12) United States Patent
Koizumi et al.

(10) Patent No.: US 8,806,848 B2
(45) Date of Patent: Aug. 19, 2014

(54) GAS TURBINE COMBUSTOR

(71) Applicant: Hitachi, Ltd., Tokyo (JP)

(72) Inventors: Hiromi Koizumi, Tokyo (JP); Tatsuya Sekiguchi, Tokyo (JP); Akinori Hayashi, Tokyo (JP); Shohei Yoshida, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 14/018,462

(22) Filed: Sep. 5, 2013

(65) Prior Publication Data

US 2014/0069079 A1 Mar. 13, 2014

(30) Foreign Application Priority Data

Sep. 5, 2012 (JP) ..... 2012-194783

(51) Int. Cl.

| | |
|---|---|
| ***F02C 3/20*** | (2006.01) |
| ***F23R 3/12*** | (2006.01) |
| ***F23R 3/14*** | (2006.01) |
| ***F23D 14/24*** | (2006.01) |
| ***F23R 3/36*** | (2006.01) |
| ***F23R 3/28*** | (2006.01) |

(52) U.S. Cl.

CPC ... *F23R 3/14* (2013.01); *F23R 3/12* (2013.01); *F23D 2204/00* (2013.01); *F23D 14/24* (2013.01); *F23R 3/36* (2013.01); *F23R 3/286* (2013.01); *F23D 2900/00008* (2013.01); *F23R 2900/00002* (2013.01)

USPC ..... 60/39.463

(58) Field of Classification Search

USPC ..... 60/39.463, 737, 740, 742, 746–748; 239/399, 400, 402, 402.5, 4

See application file for complete search history.

(56) References Cited

U.S. PATENT DOCUMENTS 3,630,024 A * 12/1971 Hopkins ..... 60/742
4,890,453 A * 1/1990 Iwai et al. ..... 60/39.465
4,993,222 A * 2/1991 Iwai et al. ..... 60/776

(Continued)

FOREIGN PATENT DOCUMENTS

| | | |
|---|---|---|
| EP | 0 278 699 | 8/1988 |
| JP | 5-86902 A | 4/1993 |
| JP | 2000-130757 | 5/2000 |
| JP | 2005-241178 A | 9/2005 |

OTHER PUBLICATIONS

EP Search Report of Appln. No. 13182876.6 dated Nov. 4, 2013 in English.

*Primary Examiner* — Phutthiwat Wongwian

(74) *Attorney, Agent, or Firm* — Antonelli, Terry, Stout & Kraus, LLP.

(57) ABSTRACT

A gas turbine combustor includes a burner disposed upstream of the combustion chamber for supplying a gas and air to an interior of the combustion chamber to hold a flame. The burner is provided with a first swirler in which a gas hole and an air hole are alternately formed in a circumferential direction. A first gas is supplied to the gas hole in the first swirler and air is supplied to the air hole. A swiveling flow path is formed in the gas hole and the air hole in the burner to swivel the gas and the air and supply the gas and the air to the interior of the combustion chamber, a second gas hole is formed in the swiveling flow path in at least one of the air hole and the gas hole, and a second gas is supplied through the second gas hole.

12 Claims, 6 Drawing Sheets

(56) References Cited

U.S. PATENT DOCUMENTS 7,143,583 B2 * 12/2006 Hayashi et al. ..... 60/776
2010/0248171 A1 * 9/2010 Hayashi et al. ..... 431/196
2011/0154829 A1 * 6/2011 Hayashi et al. ..... 60/776
2013/0019584 A1 * 1/2013 Koizumi et al. ..... 60/39.465
2013/0029277 A1 * 1/2013 Koizumi et al. ..... 431/354
2013/0219903 A1 * 8/2013 Koizumi et al. ..... 60/772

* cited by examiner

GAS TURBINE COMBUSTOR

CLAIM OF PRIORITY

The present application claims priority from Japanese patent application JP 2012-194783 filed on Sep. 5, 2012, the content of which is hereby incorporated by reference into this application.

BACKGROUND OF THE INVENTION

1. Field of the Invention

The present invention relates to a gas turbine combustor which stably burns a flame-retardant gas that has a high content of nitrogen ($N_2$), carbon dioxide ($CO_2$) or water vapor, such as a blast furnace gas, a coal gasified gas or a biomass gasified gas, and is a low calorific gas (low BTU gas).

2. Description of Related Art

In general, a low BTU gas has a low flame temperature and a low burning velocity when compared with an LNG (liquefied natural gas), which is a main fuel of the gas turbine, so the low calorific gas is a fuel that is hard to burn. However, its low NOx emissions during combustion are one of features, so a method of using a low BTU gas is an issue.

A typical example of this low BTU gas is a blast furnace gas. The blast furnace gas is a by-product gas generated from a blast furnace in a steel production process. Recently, there has been an increasing need to use this gas as a gas turbine fuel. The blast furnace gas is a flame-retardant gas that includes carbon monoxide (CO) and hydrogen ($H_2$) as the main flammable components and also includes a large amount of $N_2$ or $CO_2$.

Therefore, it is difficult to use mono-fuel combustion of a blast furnace gas to continue an operation from gas turbine ignition to a full load range. To stably continue an operation (combustion) from ignition to a partial load range in which a combustion temperature is low, it is necessary to perform carburetion during operation by mixing a coke oven gas including hydrogen or an LNG or liquefied petroleum gas (LPG), which is a high BTU gas, into a blast furnace gas or to separately provide a high calorific fuel path used for startup. Since a flame-retardant gas needs to be stably burned, it is a general practice for a gas turbine combustor to use diffusion combustion, in which a fuel and air are supplied through separate flow paths.

Other low BTU gases include gasified gases of coal and biomass. From the viewpoint of using resources efficiently, there has been also an increasing need to use a fuel made from coal or biomass as a gas turbine fuel. A fuel that is obtained by using coal, wood chips, or the like as a raw material and using air for gasification is a law BTU gas that includes a large amount of $N_2$. As in the case of a blast furnace gas, therefore, such a gas needs to be used together with a fuel used for startup and a burner that can burn a low BTU gas is required.

As described above, in general, a low BTU gas has a low flame temperature and a low burning velocity when compared with high calorific fuels such as an LNG, so the low BTU gas is a fuel that is hard to burn. As for the gas turbine combustor, therefore, a technology that stably burns a low BTU gas is an important issue.

Due to a lower heating value, to obtain a combustor exit gas temperature equivalent to that of a high BTU gas such as an LNG, it is necessary to increase the volumetric fuel flow of a fuel supplied to the combustor. Thus, one feature of a low BTU gas fired combustor is that the volumetric fuel flow of a fuel to be supplied is increased.

An example of the structure of a low BTU gas fired burner is described in the Patent Literature 1. In the Patent Literature 1, a structure is used in which a liquid fuel nozzle for startup is provided at the center in radial directions of a burner, gas holes are formed along an outer circumference of the liquid fuel nozzle, and a gas hole and an air hole are further formed alternately along an outer circumference of the outer circumference of the liquid fuel nozzle. This burner is targeted at a low BTU gas including a large amount of $N_2$ such as a coal gasified gas.

With a burner that holds a flame with a swiveled jet, to hold a flame, it is generally necessary to form a recirculation zone in the vicinity of the center in radial directions of the burner and give thermal energy to air and a fuel jetted from the burner.

In the Patent Literature 2, a low BTU gas is aggressively used to form a recirculation zone. It is characterized in that gas holes are formed in an inner swirler and most of a fuel is supplied to the inner swirler so that a strong swiveled flow is formed by using the momentum of a large amount of low BTU gas and flame holding is enhanced. The fuel jetted from the inner swirler is supplied to the recirculation zone while being mixed with air jetted from an outer swirler, so oxygen in the zone does not become insufficient and stable combustion of a low BTU gas is possible.

{Patent Literature}

{Patent Literature 1}

Japanese Patent Laid-open No. Hei 5 (1993)-86902

{Patent Literature 2}

Japanese Patent Laid-open No. 2005-241178

SUMMARY OF INVENTION

However in a gas turbine plant, as described in the Patent Literature 2, in which this type of low BTU gas is used as a main fuel to generate electric power, there is also a need to use a high BTU gas such as an LNG, rather than a liquid fuel, as a fuel for startup.

As described above, since the LNG has a heating value 10 times or more larger than low BTU gases such as blast furnace gases, the volumetric fuel flow of the LNG supplied to the combustor is reduced as the heating value is increased; the volumetric fuel flow of the LNG is reduced to about one-tenth that of the low BTU gases. When gas holes of a low BTU gas fired burner are used to burn an LNG, the jet flow velocity of the fuel is extremely lowered and the flame holding performance is thereby significantly reduced, making it difficult to burn the LNG by using low BTU gas holes. Since the gas holes cannot be shared, therefore, an LNG-specific burner for startup becomes necessary instead of a liquid fuel burner.

Since the theoretical amount of air for the LNG is larger than that of low BTU gases, if the LNG is burned by using a burner that stably burns a low BTU gas in a state in which the amount of air supplied to the burner is suppressed, air insufficiency is likely to occur. Therefore, it is desirable to form, in the LNG-specific burner, air holes next to the high BTU gas holes for stable combustion. However, there has been a problem in that, for example, if air holes are formed, the fuel density in the recirculation zone is lowered during mono-fuel combustion of a low BTU gas and the flame holding performance is thereby lowered. Another problem is that in multi-fuel combustion of a low BTU gas such as a BFG and an LNG, if the heating value of the BFG is further lowered, the chemical reaction of the fuel is slowed, so the flame holding performance is thereby lowered and the CO emission density becomes likely to increase.

An object of the present invention is to provide a gas turbine combustor, in a gas turbine that uses a low BTU gas such as a blast furnace gas as a main fuel, that enables a startup with a high calorific gas fuel such as an LNG and can improve stable combustion in multi-fuel combustion of a high BTU gas and a low BTU gas.

To solve the above problems, the present invention of a gas turbine combustor having a combustion chamber for mixing a gas and air together to burn the gas, and a burner disposed upstream of the combustion chamber for supplying a gas and air to an interior of the combustion chamber to hold a flame, wherein: the burner is provided with a first swirler in which a gas hole and an air hole are alternately formed in a circumferential direction thereof; a first gas is supplied to the gas hole in the first swirler and air is supplied to the air hole; and a swiveling flow path is formed in the gas hole and the air hole in the burner to swivel the gas and the air and supply the gas and the air to the interior of the combustion chamber, a second gas hole is formed in the swiveling flow path in at least one of the air hole and the gas hole, and a second gas is supplied through the second gas hole.

The first gas is a low BTU gas and the second gas is a high BTU gas.

According to the present invention, a gas turbine combustor, in a gas turbine that uses a low BTU gas such as a blast furnace gas as a main fuel, that enables a startup with a high calorific gas fuel such as an LNG and can improve stable combustion in multi-fuel combustion of a high BTU gas and a low BTU gas, can be realized.

Further, according to an embodiment of the present invention, since a high BTU gas hole is formed in an exit flow path in at least either the gas hole or the air hole in a low BTU gas fired burner, it becomes possible to burn a high BTU gas without lowering the jet velocity of the high BTU gas, so the flame holding performance is improved.

Further, according to an embodiment of the present invention, since air of a swirler, which takes on holing a flame of a low BUT gas, can be used, air insufficiency in mono-fuel combustion of a high BTU gas can be improved. In addition, carburetion of a low BTU gas becomes possible in the swiveling flow path in the burner by forming a high BTU gas hole in the flow path of the low BTU gas and combustion stability in multi-fuel combustion can thereby be improved.

DETAILED DESCRIPTION OF THE INVENTION

Embodiments of the present invention will be described below with reference to the drawings.

{Embodiment 1}

Figure 1:
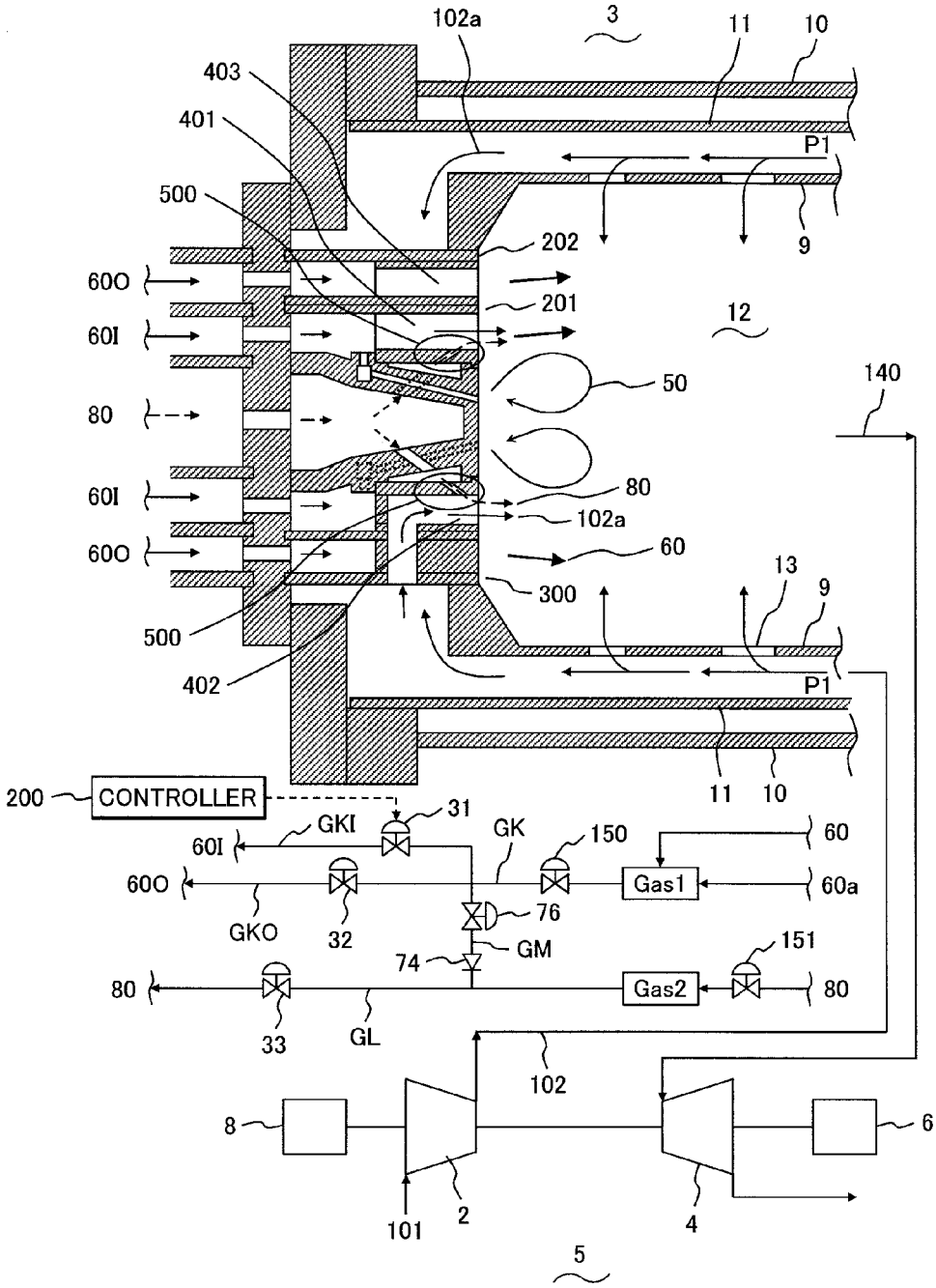
FIG. 1 is an enlarged cross sectional view of paths and a combustor in a gas turbine in an embodiment of the present invention.

FIG. 1 is an enlarged cross sectional view of paths and a combustor in a gas turbine in an embodiment of the present invention. An embodiment of the present invention uses a combustion method in which the main fuel is a low BTU fuel and a startup fuel is a high calorific fuel. In this embodiment, a blast furnace gas was used as an example of the low BTU fuel and an LNG was used as an example of the high calorific fuel.

In FIG. 1, main units that constitute a gas turbine, fuel paths, and an enlarged structure of a combustor are shown. The main units that constitute a gas turbine are a compressor 2, a combustor 3, a turbine 4, an electric power generator 6, a startup motor 8, etc. as shown at the bottom in FIG. 1.

The gas turbine 5 compresses air 101 that the compressor 2 inhaled from the atmosphere, supplies compressed air 102 to the gas turbine combustor 3, generates thermal energy by mixing and burning a fuel and air in the combustor 3, and supplies a combustion gas 140 to the turbine 4. When the combustion gas 140 is supplied to the turbine 4, the turbine 4 is given rotational power. The rotational power of the turbine 4 is transmitted to the compressor 2 and electric power generator 6. The rotational power transmitted to the compressor 2 is used as compression power, and the rotational power transmitted to the electric power generator 6 is converted to electric energy.

The fuel paths of the gas turbine are shown at the middle of FIG. 1. A fuel system is used here in which a path GK of a blast furnace gas 60 used as a low BTU gas, which is the main fuel, is provided and a path GL of an LNG gas 80 used as a high BTU gas, which is the startup fuel, is also provided. GM is a joining path used to mix the blast furnace gas 60, which is a low BTU gas, into the LNG gas 80, which is a high BTU gas, for multi-fuel combustion of the low BTU gas and high BTU gas during a fuel switchover. The use of these fuel paths enables a multi-fuel combustion operation using the blast furnace gas 60 after startup with the LNG 80 or a mono-fuel combustion operation using the blast furnace gas 60 (after a fuel switchover from the LNG to the blast furnace gas). In these gas paths, it is assumed that gases are supplied from the right side on the drawing and flow toward the left side on the drawing.

Various types of valves placed on the fuel paths of the gas turbine are controlled by a controller 200. Of these valves, valves 150 and 151 are pressure adjustment valves on the path Gk and path GL, respectively; these pressure adjustment valves determine a pressure under which a gas is supplied to a combustion chamber 12 of the combustor 3 described later. Valves 31, 32, and 33 are fuel adjustment valves; these fuel adjustment valves determine an amount of fuel supplied to the combustor 3. Thus, the volumetric fuel flow can be adjusted according to the load condition of the gas turbine 5. Moreover, valve 76 is an LNG burner backflow prevention shut-off valve provided on the joining path GM, and valve 74 is a check valve. In addition, 60*a* indicates the blast furnace gas 60 (purge air) for purging.

As illustrated in FIG. 1, paths of the blast furnace gas 60 are two paths (GKI and GKO) to correspond to a double swivel burner, which stably burns the low BTU fuel 60, and adjustment of the volumetric fuel flows supplied to the inner and outer swirlers can be made possible by the controller 200. By contrast, on the LNG gas side, only one path GL, through which a fuel is supplied to the central part of the combustion chamber, is provided.

Although, in the exemplary structure in FIG. 1, to avoid unstable combustion due to a drop of the heating value of the blast furnace gas, it is also possible to mix a coke oven furnace gas (COG: coke oven gas) having a high hydrogen content into the blast furnace gas to perform carburetion. However, the amount of COG supply depends on the amount of iron production, so a path of the LNG 80 and a path of the blast furnace gas 60 are indicated here.

The path GL of the LNG gas 80 includes the joining path GM, through which the blast furnace gas 60 is supplied to the LNG path GL to prevent the combustion gas 140 from flowing back to the interior of the LNG-specific nozzle after a fuel switchover to the blast furnace gas 60 has been completed. The path GM includes the check valve 74, which prevents the LNG gas 80 from flowing into the path GK of the blast furnace gas 60 during a mono-fuel combustion operation using the LNG or a multi-fuel combustion operation using the LNG and blast furnace gas.

After the LNG gas supply has been stopped and the operation has been switched to the mono-fuel combustion operation using the blast furnace gas, the blast furnace gas can be supplied from the LNG-specific burner by opening the shut-off valve 76, so a backflow of the combustion gas 140 can be prevented, making it possible to perform a highly reliable operation.

Finally in FIG. 1, the specific structure of the combustor will be described. The compressed air 102, high BTU gas 80, and low BTU gas 60 are led to the combustor 3. In the description below, the structure of the combustor will be described in this order.

First, a structure to lead the compressed air 102 will be described. In the combustor 3, the combustion chamber 12 is formed in an outer sleeve 10, which is a pressure vessel, with a flow sleeve 11 for combustion chamber cooling and a combustion chamber side wall 9 interposed therebetween. In a flow path P1 formed by the flow sleeve 11 and side wall 9, the compressed air 102, compressed by the compressor 2, flows from the downstream side of the combustion gas 140 in the combustor 3 toward the upstream side and is supplied to the interior of the combustion chamber 12 through air holes 13 formed in the side wall 9 of the combustion chamber 12, air holes 402 formed in a burner 300, and the like while cooling the combustion chamber 12.

Next, a structure to lead the high BTU gas 80 and low BTU gas 60 will be described. The burner 300, which jets a fuel and air into the combustion chamber 12 and holds a flame, is disposed upstream of the combustion chamber 12. The burner 300 uses a double swiveling structure formed with an inner swirler 201 and an outer swirler 202. Gas holes 401 and the air holes 402 are formed in the inner swirler 201, and gas holes 403 are formed in the outer swirler 202.

The path GKI of the path GK is connected to the inner swirler 201 and a blast furnace gas 601 is supplied to the inner swirler 201. The blast furnace gas 601 is then supplied from the gas holes 401 in the inner swirler to the interior of the combustion chamber 12. The compressed air 102 described above is led to the air holes 402 in the inner swirler 201. The path GKO of the path GK is connected to the outer swirler 202 and a blast furnace gas 600 is supplied to the outer swirler 202. The blast furnace gas 600 is then supplied from the gas holes 403 in the outer swirler to the interior of the combustion chamber 12. The volumetric flow and heating value of the low BTU gas 60 supplied to the inner swirler 201 and outer swirler 202 can be changed according to the load conditions of the gas turbine.

The high BTU gas 80 is led to the central part of the combustor 3 through the path GL, that is, a position closer to the center than the inner swirler 201, and is then supplied to the air holes 402 in the inner swirler 201 through the gas holes 500. The high BTU gas 80 is supplied to the gas holes 401 in the inner swirler 201 through the gas holes 500. The present embodiment is characterized in that the high BTU gas 80 is supplied to holes formed for air and a low BTU gas.

According to the present embodiment, with the structure illustrated in FIG. 1, an LNG is supplied in a partial load range starting from an ignition in the gas turbine, the load is increased as the combustion temperature is raided by increasing the volumetric flow of the LNG. After a load condition (50% load or higher, for example) under which mono-fuel combustion of a blast furnace gas is possible has been reached, the fuel is switched from the LNG to the blast furnace gas to enable a mono-fuel combustion operation using the blast furnace gas.

Figure 6:
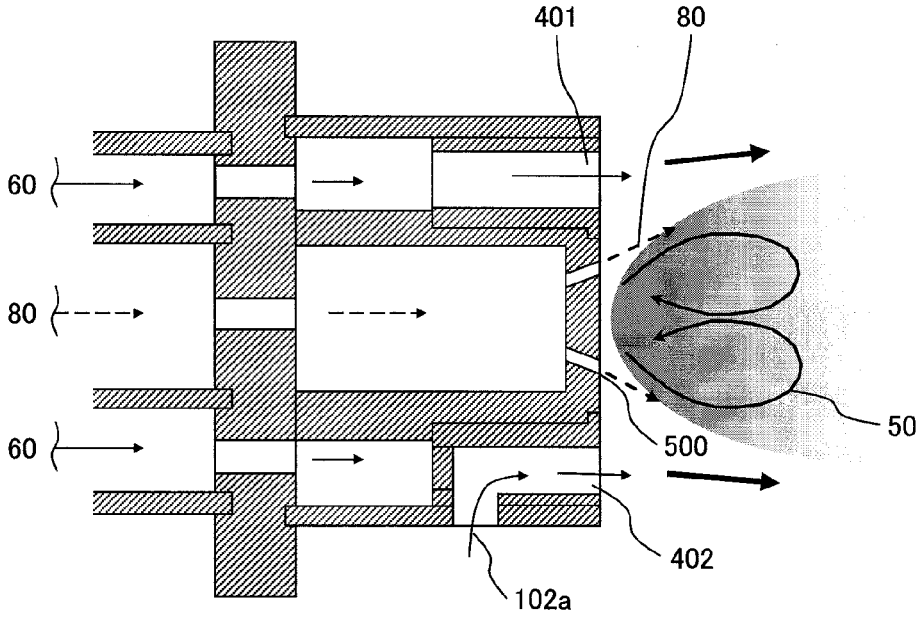
FIG. 6 (PRIOR ART)
FIG. 6 is a cross sectional view of a burner with a conventional structure.
Figure 7:
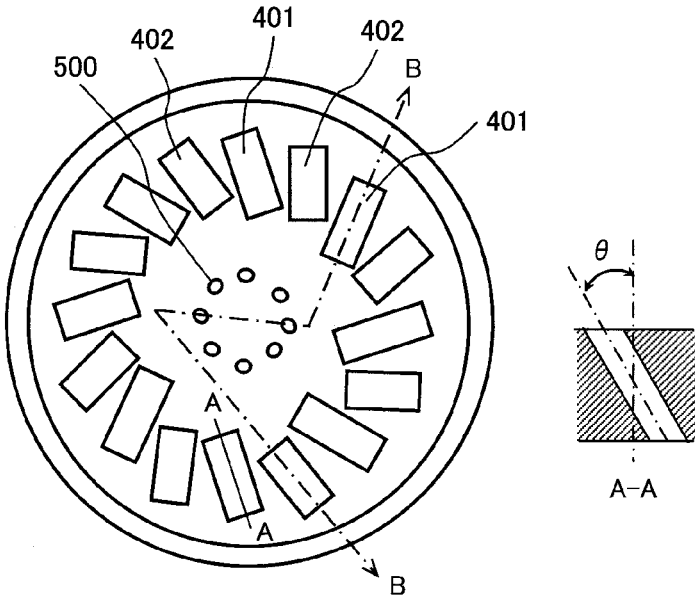
FIG. 7 (PRIOR ART)
FIG. 7 is a front view of the burner with the conventional structure.

As described above, the present embodiment is characterized in that the burner has the structure in FIG. 1 so that the high BTU gas 80 is supplied to holes formed for air and a low BTU gas. The significance of this structure will be described below through a comparison with an embodiment of a conventional burner structure. The embodiment of the conventional burner structure described below is a structure in which a low BTU gas burner and an LNG-specific burner are combined to perform a combustion operation. FIGS. 6 and 7 show a cross sectional view and a font view of a burner in an embodiment of a conventional burner structure.

The cross sectional view in FIG. 6 shows a structure in which a forward swiveling burner for the gas fuel 60 and air 102*a* (the burner is equivalent to the inner swirler of the double swivel burner in FIG. 1 and has the gas holes 401 and the air holes 402), rather than a double swivel burner, and a special burner (gas holes 500) using the LNG 80 are combined. In this embodiment, the LNG-specific burner for start-up is disposed inside a swirler that holds a flame of a low BTU gas in a radial direction of the swirler.

As shown in the front view in FIG. 7, the swirler has the low BTU gas holes 401 and the air holes 402, which are alternately formed in the circumferential direction. Thus, negative pressure develops in the vicinity of the center in radial directions of the burner due to a swivel of the low BTU gas and air 102*a*, and the fuel gas circulates in the vicinity of the center in radial directions of the swirler, forming a circulation gas zone 50. The circulation gas zone 50 plays a role in continuously giving thermal energy to the fuel and air supplied from the swirler, enhancing flame holding.

The LNG-specific burner has the gas holes 500 used to jet the high BTU gas 80 in the end surface of the burner. Combustion of a high BTU gas is made possible by jetting the LNG 80 to the interior of the combustion chamber through the gas holes 500. In the mono-fuel combustion operation using the LNG, the purge air 60*a* or the like needs to be supplied to prevent the combustion gas 140 from flowing back to another combustor through the gas hole 401. When the fuel is switched from the LNG 80 to the blast furnace gas 60, the blast furnace gas 60 is supplied through the gas holes 401 and the multi-fuel combustion operation is finally switched to the mono-fuel combustion operation using the blast furnace gas.

On the right side of the front view of the burner in FIG. 7, the cross section A-A of the low BTU gas hole 401 and air hole 402 is shown. According to this drawing, a swiveling angle θ is provided to the hole to give a swivel. A plurality of gas holes 500 for the LNG are formed in the vicinity of the center in radial directions.

A relationship between the cross section in FIG. 6 and the front view in FIG. 7 is such that the cross section B-B in FIG. 7 is represented in FIG. 6. To indicate an example taken when jets are made from both holes for a gas and air on a drawing, such a cross section is shown. Although similar descriptions are omitted for FIGS. 2 and 3 and for FIGS. 8 and 9, a cross section is shown on the basis of the same concept.

Figure 2:
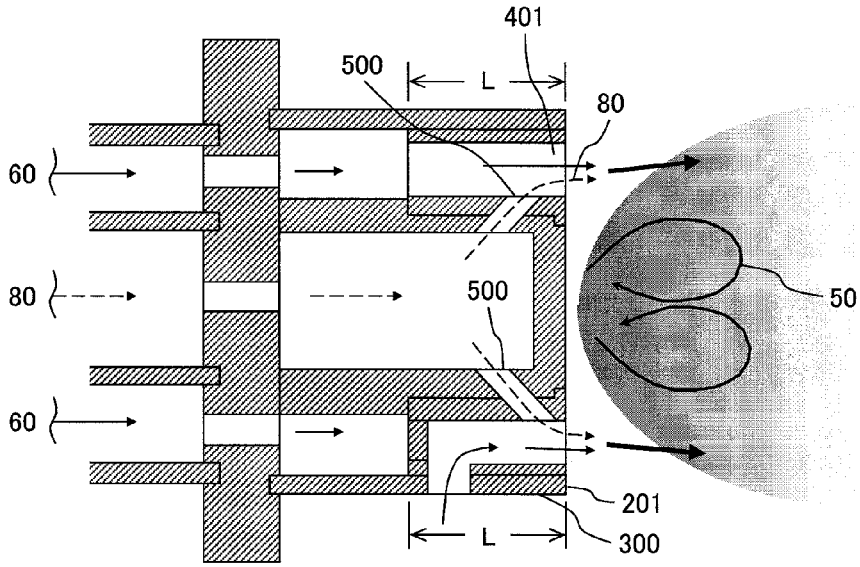
FIG. 2 is a cross sectional view of a burner in the combustor of the embodiment shown in the FIG. 1.
Figure 3:
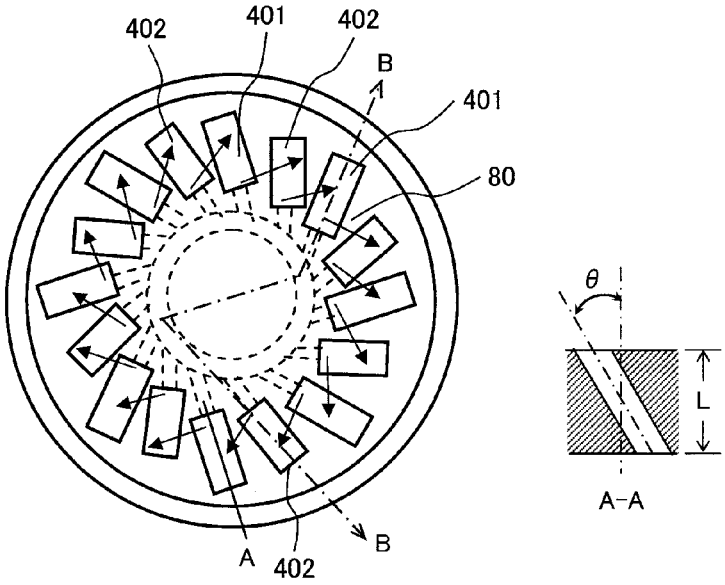
FIG. 3 is a front view of the burner in the embodiment shown in the FIG. 2.

In a burner structure having the layout shown in FIGS. 2 and 3, a plurality of air holes are formed around the gas holes 500 to improve air insufficiency in mono-fuel combustion using the LNG. As a result, the fuel density in the circulation gas zone 50 taking on flame holding is reduced and combustion performance in low BTU gas firing is thereby likely to be lowered.

That is, in the conventional burner structure, a high BTU gas is supplied directly to the combustion chamber and a plurality of air holes are formed around the gas holes 500 to compensate for air insufficiency in the combustion chamber. This has led to a reduction in combustion.

In the gas turbine combustor of the present embodiment, therefore, it has been decided that a high BTU gas is not supplied directly to the combustion chamber. In the gas turbine combustor of the present embodiment, as shown in the cross sectional view of the burner in FIG. 2, a high BTU gas is supplied to the swiveling flow path L of one of the low BTU gas hole 401 and air hole 402. Thus, the gas hole 500 for the high BTU gas (LNG 80) is formed in the swiveling flow path L in the low BTU gas hole 401 or air hole 402.

In the burner of the gas turbine combustor in the present embodiment, FIG. 2 shows an embodiment of a structure in which the gas hole 500 for the LNG 80 is formed in the swiveling flow paths L in both the gas hole 401 and air hole 402. In FIG. 2, the swiveling flow path is equivalent to L shown in the drawing. In this structure, the LNG 80 is jetted from the vicinity of the exits of the swiveling flow paths of the gas hole 401 and air hole 402, the LNG 80 and compressed air 102 are adjacent to each other in the vicinity of the inlet of the combustion chamber, so unstable combustion due to insufficient air, which has been described in the conventional structure, can be improved.

Since the gas hole 500 for the LNG 80 is formed in the swiveling flow path in the low BTU gas hole 401 or air hole 402, although a swirler for the blast furnace gas 60 is used, combustion at an optimum fuel jet velocity is possible because the jet flow velocity of the LNG 80 depends on the exit area of the gas hole 500, enabling the LNG to be stably burned by the low BTU gas burner.

When the fuel is switched from the LNG 80 to the blast furnace gas 60, the LNG 80 is mixed into the blast furnace gas 60 in the gas hole 401. Accordingly, the blast furnace gas 60 undergoes carburetion by the LNG 80 in the swiveling flow path of the swirler, so combustion stability during multi-fuel combustion operation can be improved. When the heating value of the blast furnace gas 60 is lowered, this effect is particularly noticeable.

FIG. 3 shows the burner in FIG. 2 when viewed from the front. In this structure, the LNG 80 is jetted from both the gas hole 401 and the air hole 402. The jetted LNG 80 is mixed with the adjacent swirler air 102*a*, enabling stable combustion. In a case as well in which the LNG 80 for startup is jetted only from the gas hole 401 or only from the air hole 402, the same effect as when the LNG 80 is jetted from both the hole for the gas and the hole for the air as described above is obtained.

According to the above description, a high BTU gas is preferably jetted from one of the hole for a low BTU gas and the hole for air. To make multi-fuel combustion stable, however, a high BTU gas is preferably jetted from both the hole for a low BTU gas and the hole for air. To compensate for oxygen insufficiency, however, a high BTU gas is preferably jetted from the hole for air.

Figure 4:
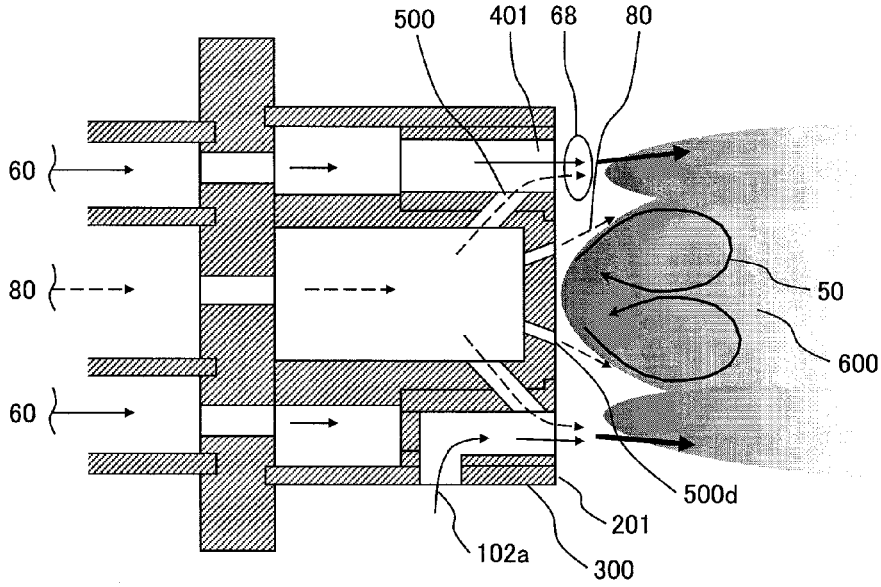
FIG. 4 is a cross sectional view of a burner in another embodiment of the present invention.
Figure 5:
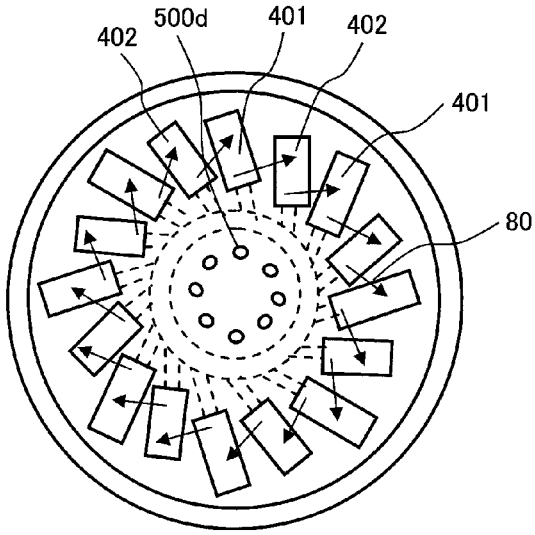
FIG. 5 is a front view of the burner in the embodiment shown in the FIG. 4.

Another embodiment of the burner structure in the gas turbine combustor according to the present invention is shown in FIGS. 4 and 5. The cross section of the burner in FIG. 4 differs from the burner in FIG. 2 in that LNG holes 500*d* are formed on the end surface of the LNG-specific burner. The LNG hole 500*d* formed in the end surface of the burner has the same structure as with the burner described with reference to FIG. 6, but a partial fuel of the entire LNG flow is supplied from the hole 500*d*. Therefore, although a diffused LNG flame is formed on the end surface of the burner, part of the fuel is jetted, so air insufficiency can be improved.

In this structure, a pilot flame 600 of an LNG formed on the front surface of the burner is used as an ignition source in multi-fuel combustion operation, and a carburetion gas 68 resulting from the mixing of the blast furnace gas 60 and LNG 80 in the swivel gas flow path in the burner is supplied from the inner swirler 201. Therefore, the reactivity of the carbureted blast furnace gas 68 is increased and combustion stability in multi-fuel combustion operation is improved.

Particularly, since the LNG 80 is supplied from the center side in radial directions in the swiveling flow path, the LNG density of the carburetion gas 68 in the present embodiment is increased toward the center side in radial directions (LNG burner side) when compared with a case in which the blast furnace gas is carbureted in advance by mixing an LNG on the upstream side of the combustor. Therefore, when the carburetion gas is adjacent to the pilot flame 600, the chemical reaction is made faster because the LNG density of the carburetion gas is high. As a result, a stable multi-fuel combustion operation is possible.

After the fuel has been switched from the LNG to the blast furnace gas, the blast furnace gas 60 is supplied to the LNG-specific burner, preventing the combustion gas from flowing back after the LNG has stopped.

FIG. 5 is a front view of the burner in FIG. 4. The burner is structured so that a plurality of LNG holes 500*d* are formed in the vicinity of the center in radial directions of the burner and the LNG 80 is jetted into the swiveling flow paths of the gas hole 401 and air hole 402 formed in the swirler for the low BTU gas.

This structure is characterized in that combustion in which the swirler air 102*a* is aggressively used is possible and that multi-fuel combustion in which a pilot flame formed in the vicinity of the center in radial directions of the burner is aggressively used and operation in which the fuel is switched are also possible.

Figure 8:
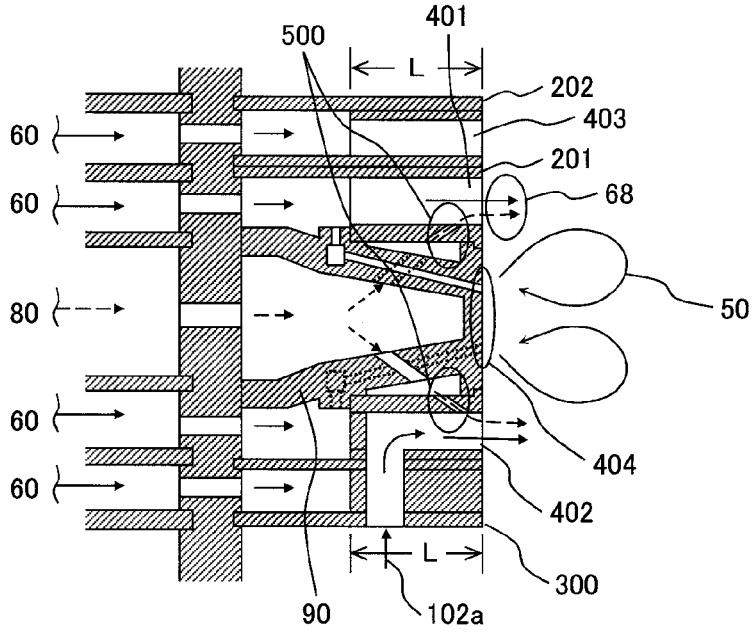
FIG. 8 is a cross sectional view of a burner in still another embodiment of the present invention.
Figure 9:
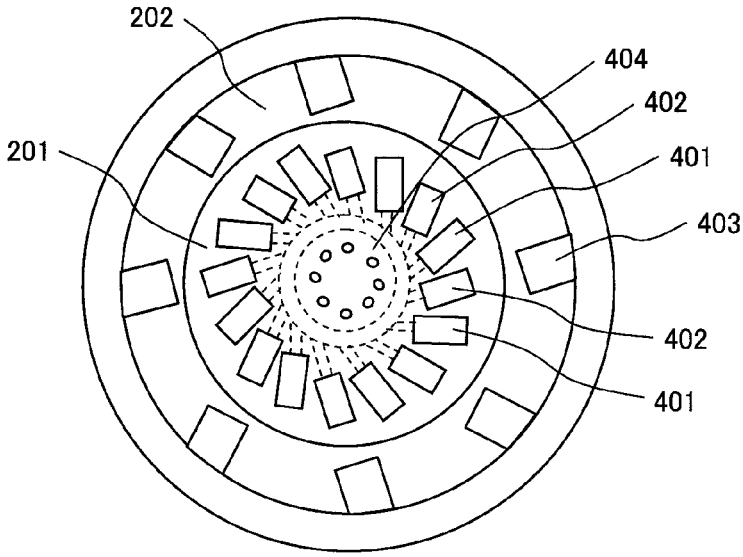
FIG. 9 is a front view of the burner in the embodiment shown in the FIG. 8.

Another embodiment of the burner structure in the gas turbine combustor according to the present invention is shown in FIGS. 8 and 9. This structure is a combination of a double swivel burner (formed with the inner swirler 201 and outer swirler 202), used to further stably burn a low BTU gas, and an LNG-specific burner. The structure in FIG. 8 is similar to the structure in FIG. 1, so the structure in FIG. 9 will be first described.

According to the front view of the burner in the present embodiment shown in FIG. 9, flame holding enhancing fuel holes 404 are formed in the vicinity of the center in radial directions of the burner, the inner swirler 201 is placed on an outer circumference of the flame holding enhancing fuel holes 404, and the outer swirler 202 is placed on an outer circumference of the inner swirler 201. The gas hole 500 for an LNG is formed in the swiveling flow paths of the gas hole 401 and air hole 402 in the inner swirler 201. The jetted LNG is mixed with the air 102*a* jetted from the air hole 402 and purge air supplied through the gas holes 401 and 403 and the mixture is burned, enabling stable combustion.

As clearly shown in FIG. 9, the gas holes 401 and air holes 402 are alternately formed in the inner swirler 201, and the holes 403 used to supply part of the blast furnace gas 60 are formed in the outer swirler 202 to enhance stability of the low BTU gas firing burner. The structure described so far is the same as in FIG. 1.

In FIGS. 8 and 9, the flame holding enhancing fuel holes 404, which enhance flame holding during mono-fuel combustion using a low BTU gas, are further formed inside the inner swirler 201 in its radial directions. To supply the LNG 80 to the flame holding enhancing fuel holes 404 as a flame holding enhancing fuel, the LNG 80 can be jetted into the combustion chamber by using an LNG burner tile 90.

The LNG burner tile 90 has gas holes 401 in the inner swirler 201 and also has air holes 500, each of which is used to jet the LNG 80 from the swiveling flow path L in the air hole 402. During operation by using the LNG 80, it becomes possible to prevent the combustion gas 140 from flowing back to the gas holes by supplying the purge air 60*a* to the gas holes 401 and 403 in the inner and outer swirlers 201, 202.

To stably burn a low BTU gas, it is generally burned by suppressing the amount of air to the burner. If an LNG is burned with a burner for which the amount of air is suppressed, therefore, air insufficiency is likely to occur due to a difference in the theoretical amount of air. With the double swivel burner as shown in FIGS. 1 and 8, however, purge air is supplied through the gas holes 401 and 403 in the inner and outer swirlers 201, 202 during LNG operation, so air can be widely supplied to the outside in radial directions. Therefore, air insufficiency in LNG firing can be improved and stable combustion becomes possible.

A method of operating the low BTU gas firing gas turbine combustor having the structure described so far will be described with reference to FIG. 1.

At startup, the gas turbine is driven by an external force such as the startup motor 8. In the external driving state, the fuel adjustment valves 31, 32, and 33 are closed, and a gas fuel is not supplied at all. When the rotational speed of the gas turbine is maintained at a rotational speed equivalent to an ignition condition for the combustor 3, the compressed air 102 necessary for ignition is supplied to the combustor 3 and the ignition condition holds.

At a speed increasing and low-load operation stages at the beginning of the startup of the gas turbine, a mono-fuel combustion operation using a high BTU gas is performed. Thus, the fuel adjustment valve 33 is opened and the LNG 80, which is a high BTU gas, is supplied to the burner 300, enabling ignition in the combustor 3. Due to the ignition in the combustor 3, the combustion gas 140 is supplied to the turbine 4. When the volumetric flow of the LNG 80 is increased, the speed of the turbine 4 is also increased. When the startup motor 8 is separated, the gas turbine enters an autonomous operation and reaches a full speed no load condition.

Since the pressure in the combustor is increased as the speed is increased, the purge air 60*a* is supplied to the gas holes 401 and 403 in the burner 300 to prevent the combustion gas 140 from flowing back to another combustor. In the gas paths in FIG. 1, the fuel adjustment valves 31 and 32 are opened to supply the purge air 60*a* to the two paths (GKI and GKO) of the blast furnace gas 60.

After the gas turbine has reached the full speed no load condition, the electric power generator 6 is connected with a total grid and the inlet gas temperature of the turbine 4 is raised due to an increase in the volumetric flow of the LNG 80, increasing the load. When the temperature of the combustion gas 140 is raised at the exit of the combustor 3 due to the increase in the load, combustion stability is increased, so a fuel switchover from the LNG 80 to the blast furnace gas 60 becomes possible.

In the fuel switching state, multi-fuel combustion of a high BTU gas and a low BTU gas is carried out. In the burner 300, the volumetric flow of the purge air 60*a* is reduced and the volumetric flow of the low BTU gas 60 is increased, after which an operation to switch the fuel from the LNG 80 to the blast furnace gas 60 is started. In the fuel switchover, the blast furnace gas 60 can be partially carbureted by the LNG 80 in the gas holes in the burner 300, so stable combustion is possible.

After the fuel has been switched, the shut-off valve 76 on the joining path GM of the path LG of the blast furnace gas path GK and LNG path GL is opened and the volumetric flow is adjusted by the fuel adjustment valve 33 on the LNG path, making it possible to prevent the combustion gas 140 for the LNG-specific burner from flowing back. After the fuel has been switched to the blast furnace gas 60, the volumetric flow of the blast furnace gas 60 is further increased to increase the load and the full load condition is thereby reached.

Figure 10:
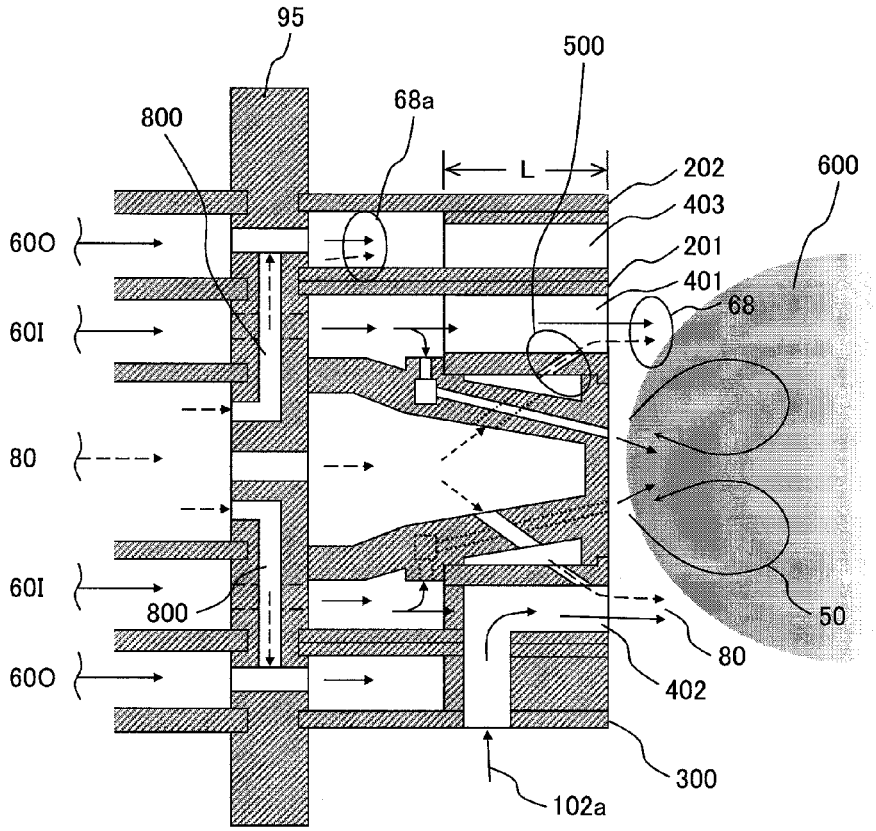
FIG. 10 is a cross sectional view of a burner in yet another embodiment of the present invention.

FIG. 10 is a cross sectional view of a burner of the gas turbine combustor in another embodiment of the present invention. Unlike the structure, illustrated in FIG. 8, in which the double swivel burner and LNG-specific burner are combined, the structure in FIG. 10 is characterized in that the LNG 80 is mixed into a blast furnace gas 600 as well, which is supplied from the outer swirler 202. If a gas hole used to jet the LNG 80 is disposed in the swiveling flow path L in the gas hole 403 in the outer swirler 202, the structure is likely to become complex. In FIG. 10, therefore, a flange 95 is used to secure the burner, pipes to supply fuels to the burner, and the like. In the embodiment in FIG. 10, therefore, gas holes 800 are formed in the flange 95 and the LNG 80 is mixed into the blast furnace gas 60O. Thus, the LNG 80 is joined to the blast furnace gas 60 to be supplied to the outer swirler 202 in the interior of the flange 95 and a carburetion gas 68*a* is supplied from the gas holes 403 as well in the outer swirler 202.

Accordingly, when a flame of the blast furnace gas 60 is formed in the inner swirler 201, an outer circumferential flame 602 is likely to be formed during multi-fuel combustion because the chemical reaction of the carburetion gas 68*a* supplied from the outer swirler 202 is faster than the chemical reaction of the blast furnace gas 60. Therefore, multi-fuel combustion with emissions of CO and other unburned content suppressed becomes possible.

The LNG 60 supplied to the inner swirler 201 and outer swirler 202 is determined in proportion to the area of the interior of the fuel nozzle body, so a valve used for mixing into the blast furnace gas is not required. After the fuel has been switched, if the blast furnace gas 60 is branched from the path of the LNG 80 and is supplied, it becomes possible to prevent the combustion gas 140 from flowing back through the LNG-specific nozzle.

As described so far, when this burner structure is used, mono-fuel combustion of an LNG, multi-fuel combustion of an LNG and a blast furnace gas, and mono-fuel combustion of a blast furnace gas becomes possible. Although this embodiment has been described by using an LNG as an embodiment of a high BTU gas, a similar effect can also be obtained from a gas fuel such as an LPG and butane.

The invention claimed is:

1. A gas turbine combustor having a combustion chamber for mixing a gas and air together to burn the gas, and a burner disposed upstream of the combustion chamber for supplying a gas and air to an interior of the combustion chamber to hold a flame, wherein:

the burner is provided with a first swirler comprising a gas hole and an air hole alternately formed in a circumferential direction thereof;

a first gas from a first gas source is supplied to the gas hole in the first swirler and air is supplied to the air hole; and a swiveling flow path is formed in the gas hole and the air hole in the burner to swivel the gas and the air and supply the gas and the air to the interior of the combustion chamber, a second gas hole is formed in the swiveling flow path in at least one of the air hole and the gas hole, and a second gas from a second gas source is supplied through the second gas hole.

2. The gas turbine combustor according to claim 1, wherein:

the first gas is a low BTU gas and the second gas is a high BTU gas.

3. The gas turbine combustor according to claim 1, wherein:

the burner is provided with a plurality of gas holes in an end surface on an inner circumferential side of the first swirler in a radial direction, and the second gas is supplied to the interior of the combustion chamber through the plurality of gas holes.

4. The gas turbine combustor according to claim 1, wherein:

the burner is provided with a second swirler in which a gas hole is formed, the second swirler is disposed on an outer circumferential side of the first swirler in a radial direction, the first gas is supplied to the gas hole in the second swirler, another swiveling flow path is formed in the gas hole in the second swirler, the another swiveling flow path being used to swivel the first gas and supply the first gas to the interior of the combustion chamber.

5. The gas turbine combustor according to claim 4, wherein:

a third gas hole is formed on an upstream side of the swiveling flow path formed in the gas hole in the second swirler, the third gas hole being used to supply the second gas.

6. The gas turbine combustor according to claim 1, wherein:

the first gas is a low BTU gas selected from the group consisting of a blast furnace gas, a coal gas, and a biogas; and the second gas is a high BTU gas selected from the group consisting of an LNG, an LPG, and a butane gas.

7. A gas turbine combustor comprising:

a combustion chamber; and a burner disposed upstream of the combustion chamber, wherein the burner comprises a first swirler, the first swirler comprises at least one gas hole and at least one air hole alternately formed in a circumferential direction of the first swirler;

a first gas from a first gas source is supplied to the at least one gas hole in the first swirler and air is supplied to the at least one air hole; and a swiveling flow path is formed in the at least one gas hole and the at least one air hole in the first swirler to swivel the gas and the air and to supply the gas and the air to the interior of the combustion chamber, a second gas hole is formed in the swiveling flow path in at least one of the at least one air hole and the at least one gas hole, and a second gas from a second gas source is supplied through the second gas hole.

8. The gas turbine combustor according to claim 7, wherein:

the first gas is a low BTU gas and the second gas is a high BTU gas.

9. The gas turbine combustor according to claim 7, wherein:

the burner is provided with a plurality of gas holes in an end surface on an inner circumferential side of the first swirler in a radial direction, and the second gas is supplied to the interior of the combustion chamber through the plurality of gas holes.

10. The gas turbine combustor according to claim 7, wherein:

the burner is provided with a second swirler in which a gas hole is formed, the second swirler is disposed on an outer circumferential side of the first swirler in a radial direction, the first gas is supplied to the gas hole in the second swirler, another swiveling flow path is formed in the gas hole in the second swirler, and the another swiveling flow path is used to swivel the first gas and to supply the first gas to the interior of the combustion chamber.

11. The gas turbine combustor according to claim 10, wherein:

a third gas hole is formed on an upstream side of the another swiveling flow path formed in the gas hole in the second swirler, the third gas hole being used to supply the second gas.

12. The gas turbine combustor according to claim 7, wherein:

the first gas is a low BTU gas selected from the group consisting of a blast furnace gas, a coal gas, and a biogas; and the second gas is a high BTU gas selected from the group consisting of an LNG, an LPG, and a butane gas.

* * * * *